United States Patent [19]

Liebscher et al.

[11] 4,040,546

[45] Aug. 9, 1977

[54] HOLLOW PLASTIC GARMENT HANGER

[75] Inventors: Johannes Liebscher, Nassau, Lahn; Rolf G. Schülein, Singhofen, both of Germany

[73] Assignee: Leifheit International Gunter Leifheit GmbH, Nassau, Lahn, Germany

[21] Appl. No.: 637,857

[22] Filed: Dec. 8, 1975

[30] Foreign Application Priority Data

Dec. 6, 1974 Germany ..... 2457738

[51] Int. Cl.[2] ..... A47J 51/097

[52] U.S. Cl. ..... 223/88

[58] Field of Search ..... 223/85, 86, 88, 98, 223/94, 92; 403/344; 85/19; 29/453

[56] References Cited

U.S. PATENT DOCUMENTS

| | | | |
|---|---|---|---|
| 2,137,268 | 11/1938 | Clairon | 223/86 |
| 2,279,955 | 4/1942 | Sipe | 85/119 X |
| 2,562,566 | 7/1951 | Meyerhoff | 223/92 |
| 2,586,913 | 2/1952 | Burns | 223/94 |
| 2,984,394 | 5/1961 | Chankin | 223/91 |
| 3,257,049 | 6/1966 | Smith | 223/88 |
| 3,467,291 | 9/1969 | Phillips et al. | 223/85 |
| 3,588,149 | 6/1971 | Demler et al. | 285/DIG. 22 |
| 3,898,495 | 8/1975 | Livera | 403/344 |

FOREIGN PATENT DOCUMENTS

| | | | |
|---|---|---|---|
| 1,101,641 | 4/1955 | France | 223/94 |

*Primary Examiner*—George H. Krizmanich
*Attorney, Agent, or Firm*—Michael J. Striker

[57] ABSTRACT

A hanger has an elongated hanger body which includes a pair of shell-shaped hanger halves which are separated from one another along a longitudinal plane of symmetry of the hanger body. Male and female connecting elements in form of pins and sleeves for receiving the pins extend across the plane of symmetry and engage one another when the two hanger halves are assembled. The marginal portions of the hanger halves are formed with grooves and bulges, the bulges being received with snap action into the grooves of the associated one of the hanger halves when the two hanger halves are assembled with one another. The hanger halves are formed with partial bearings which together form a full bearing for receiving a support portion of a shaft of a suspension element of hook-shaped configuration, which bearing is adjacent to and communicates with an opening which leads to the exterior of the assembled hanger body. The bearing mounts the shaft of the suspension element for rotation relative to the hanger body and prevents axial movement of the suspension element. The connecting pins are provided with external clamping projections which engage the inner surface of the connecting sleeve and prevent disassembly of the assembled hanger body.

14 Claims, 9 Drawing Figures

10
13
14
15
20
21
IV
IV
V
V 17
11
27
10
12
16
16
20

11
12
16
18
19
17
17
18
19

HOLLOW PLASTIC GARMENT HANGER

BACKGROUND OF THE INVENTION

The present invention relates to a hanger in general, and more particularly to a hanger of synthetic plastic material.

There are already known various constructions of hangers of synthetic plastic material which, in all prior art constructions, include a one-piece hanger body of a synthetic plastic material. In many instances, such hangers of synthetic plastic material have only a low stability so that they are suited only for hanging garments and wardrobe components thereon which are of relatively low weight.

The prior art has also recognized and problems arising from the low stability of such hangers of synthetic plastic material and, in order to avoid this disadvantage, it has been proposed to provide massive clothes-hangers of synthetic plastic material which are capable of withstanding higher stresses and thus are suited for hanging heavier wardrobe components, such as jackets, coats and/or pants thereon. However, such massive hangers require a relatively high amount of the synthetic plastic material for their production so that these hangers are relatively expensive, which has heretofore prevented such hangers from gaining widespread acceptance. As a matter of fact, such massive hangers are only slightly lower in price than the conventional wooden hangers which, in many instances, resulted in the purchases of a hanger giving preference to a slightly more expensive but apparently more durable wooden hanger.

SUMMARY OF THE INVENTION

Accordingly, it is a general object of the present invention to avoid the disadvantages of the prior-art hangers. More particularly, it is an object of the present invention to provide a hanger of synthetic plastic material which is in its properties superior to a wooden hanger.

It is a further object of the present invention to provide a hanger of synthetic plastic material which is simple in construction and reliable in operation.

It is a concomitant object of the present invention to provide a hanger of synthetic plastic material which is extremely stable and rigid but which requires only a small amount of synthetic plastic material for its manufacture.

Yet another object of the present invention is to provide a hanger which can be assembled from various parts with only minimum skill on the part of the assembling personnel.

In pursuance of these objects and others which will become apparent hereafter, one feature of the present invention resides, briefly stated, in a hanger, in a combination which comprises an elongated hanger body which includes a plurality of shell-shaped hanger elements separated from one another in the longitudinal direction of the hanger body; means for connecting shell-shaped hanger elements to one another to form the hanger body; and at least one hook-shaped suspension element which is connected to the hanger body.

In a currently preferred embodiment of the present invention, the connecting means includes cooperating male and female connecting portions formed on the shell-shaped hanger elements, wherein the female connecting elements matingly and arrestingly receive the male connecting elements for connecting the hanger elements with one another. Due to the fact that the hanger elements are shell-shaped and connected with one another by the cooperating male and female connecting portions, the hanger body has a low weight coupled with high rigidity, so that it is not necessary to provide any additional and separate connecting elements serving the purpose of connecting the hanger elements with one another.

In a currently preferred embodiment of the present invention, the hanger body includes two shell-shaped hanger halves, and the connecting means includes pins and sleeves formed on the shell-shaped hanger halves, the pins being received in the central openings of the sleeves. The pins and the sleeves are distributed over their respective shell-shaped hanger halves so that when the shell halves are assembled with one another, always one of the pins will be aligned and associated with one of the sleeves. All of the pins may be provided on one of the hanger halves, and all of the sleeves may be formed on the other one of the hanger halves, or both halves may carry both the pins and the sleeves which may be interspersed with one another, or one region of each of the shell-shaped hanger halves may have only the pins and another region of the same hanger halves may have the sleeves formed thereon, as long as it is assured that, when the hanger halves are assembled, each of the pins will be aligned with a corresponding associated sleeve.

According to a further currently preferred embodiment of the invention it is proposed, in order to improve the connection of the hanger halves to one another, to provide marginal portions of the respective shell-shaped hanger halves with grooves and with associated bulges on the other shell-shaped hanger half, at the marginal portions of the shell-shaped hanger halves. The grooves and the bulges are so constructed and so distributed that, when the two shell-shaped hanger halves are assembled with one another and pressed against each other, the respective bulges are received in and engage and grooves with snap action, thus connecting the two shell-shaped hanger halves to one another. In this manner, it is achieved that the two hanger halves are rigidly and undismountably connected to one another.

According to a further embodiment of the present invention, the two shell-shaped hanger halves may be provided with partial bearings which together constitute a complete bearing for receiving a support portion of a shaft of a suspension element which is to be connected to the hanger body. When the shell-shaped hanger halves are constructed in such a manner, the shaft of the suspension element which carries the support portion can be situated in one of the partial bearings or depressions prior to the assembly of the two hanger halves, upon which the other shell-shaped hanger half is assembled with the one shell-shaped hanger half so that a complete bearing for reliably supporting the support portion of the shaft of the suspension element is obtained. The bearing prevents the shaft of the suspension element, which may be of a hook-shaped configuration, from moving axially of itself and thus from disociating from the hanger body. The hanger halves may also be formed with other depressions which together form an opening which communicates the bearing with the exterior of the hanger body and which receives the shaft of the suspension element. The bearings, together with the openings, mount the suspension element in the hanger body for rotation relative thereto about an axis of the shaft, whereby the angular position of the hook-shaped portion of the suspension element relative to the elongation of the hanger body can be adjusted.

The connecting pins can have a substantially circular cross-section and may be provided with clamping bulges over their entire exterior surfaces, which outwardly extending bulges compensate for manufacturing tolerances which are unavoidable and arrestingly engage the inner surfaces of the connecting sleeves. Thus, the outwardly extending bulges of the connecting pins provide for an especially strong connection of the two shell-shaped hanger halves with one another once such shell-shaped hanger halves are assembled.

According to a further currently preferred feature of the present invention, the hanger body may be formed with an additional opening for receiving ties, belts, scarves and similar articles. When the hanger is to be used for hanging suits thereon, it is proposed that a cross-tie which interconnects the spaced ends of the hanger body be formed of one piece with the hanger body or the respective hanger half which forms a part of the hanger body, such cross-tie serving the purpose of hanging pants thereon.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figures 1, 2, 3:
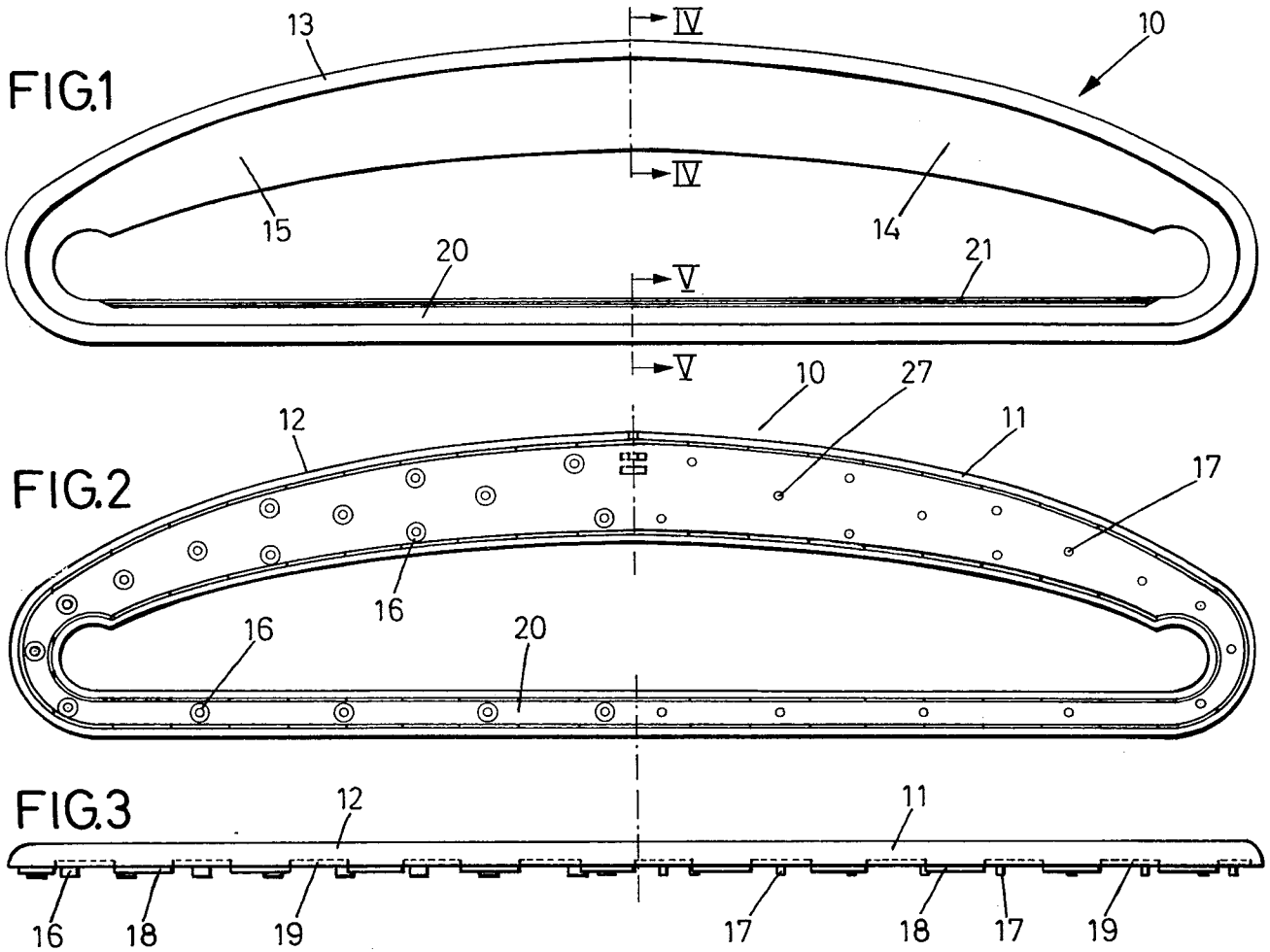
FIG. 1 is a side elevational view of one embodiment of a hanger body of the present invention.
FIG. 2 is a view of the interior of one of the hanger halves which together constitute the hanger body.
FIG. 3 is a top plan view of the hanger halves illustrated in FIG. 2.

Referring now to the drawings, and first to FIGS. 1 to 7 thereof which show a first exemplary embodiment of the present invention, it may be seen therein that a hanger is designated in toto with a reference numeral 10. The hanger 10 of this embodiment is of such a construction as to be suited for hanging suits thereon. The hanger 10 includes, as can be ascertained most clearly from FIG. 4, a pair of one-piece shell-shaped hanger halves 11 and 12. The shell-shaped hanger halves 11 and 12 may be assembled with one another in a manner which will be explained in more detail later on, and together they constitute a hanger body 13 which is elongated and has a right shoulder 14 and a left shoulder 15. As illustrated particularly in FIGS. 2 and 3, the inner surfaces of the shell-shaped hanger halves 11 and 12 are provided with a plurality of connecting sleeves 16 which are spaced from one another, and with connecting pins 17 which are so arranged as to be aligned with their associated connecting sleeves 16 when the two shell-shaped hanger halves are assembled with one another. In this connection, it is to be mentioned that all of the connecting sleeves 16 may be provided, for instance, on the hanger half 12 while the connecting pins 17 are all formed on the shell-shaped hanger half 11, or each of the shell-shaped hanger halves 11 and 12 may be formed with some of the coupling sleeves 16 and with some of the coupling pins 17, as long as it is assured that, when the two shell-shaped hanger halves 11 and 12 are assembled with one another, always one of the pins 17 is associated and aligned with one of the sleeves 16. Referring now again to FIGS. 4 and 5, it may be seen therein that the peripheral edge portions of the two shell-shaped hanger halves 11 and 12 are raised and bound recesses which latter form together a hollow interior of the hanger body when the hanger halves are connected with one another. The peripheral edge portions are formed with projecting bulges 18 and with corresponding grooves 19 which are located between the bulges 18. The bulges 18, as well as the grooves 19, are provided with engaging portions 31 and 32, respectively, which engage one another in the assembled position of the hanger halves 11 and 12.

The ends of the hanger body 13 are connected with one another by means of a cross-tie 20. This cross-tie 20, which is formed by the lower regions of the shell-shaped hanger halves 11 and 12, serves the purpose of hanging pants thereon. In order to prevent the pants from sliding off the cross-tie 20, the upper region of the cross-tie 20 is provided with corrugations 21.

Figure 4:
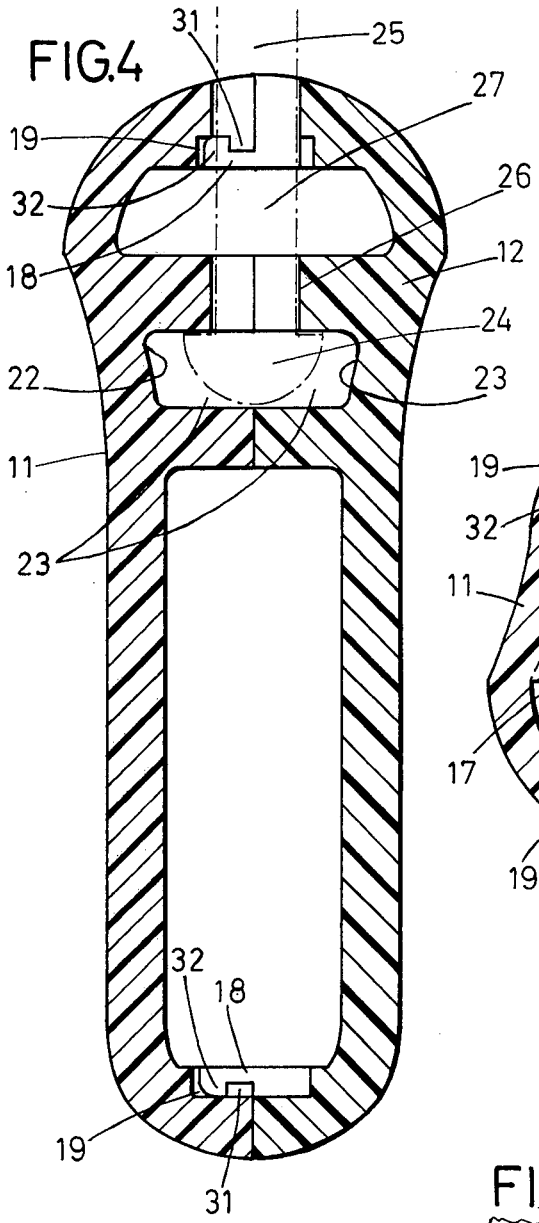
FIG. 4 is an enlarged cross-sectional view taken on line IV—IV of FIG. 1.
Figure 5:
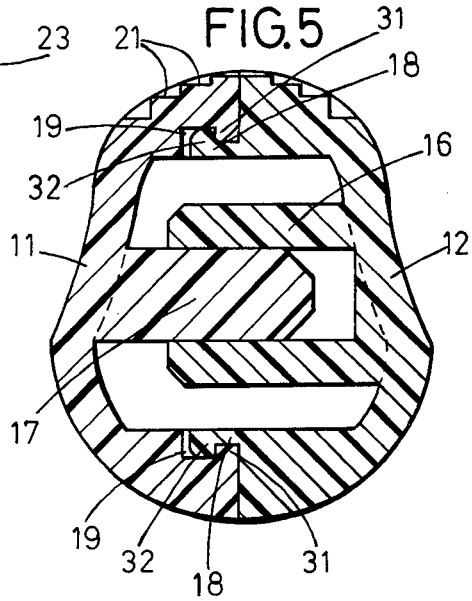
FIG. 5 is an enlarged cross-sectional view taken on line V—V of FIG. 1.

As FIG. 4 shows most clearly, the shell-shaped hanger halves 11 and 12 are each provided in the upper region of the central portion of the hanger body 13 with a depression 22, which depressions 22 of the hanger halves 11 and 12 together form a bearing 23 for a head 24 of a hook-shaped suspension element 25 which head 24 serves as a support portion. An opening 26 is provided adjacent and communicates with the bearing 23, which opening 26 is so formed in the mutually abutting surfaces of the two shell-shaped hanger halves 11 and 12 that the longitudinal plane of symmetry of the hanger body 13 divides the opening 26 into two halves. The inner diameter of the opening 26 is somewhat larger than the outer diameter of a shaft 27 of the suspension element 25, so that the hook-shaped suspension element 25 can rotate in the bearing 23 and in the opening 26 about the axis of the shaft 27.

Figure 6:
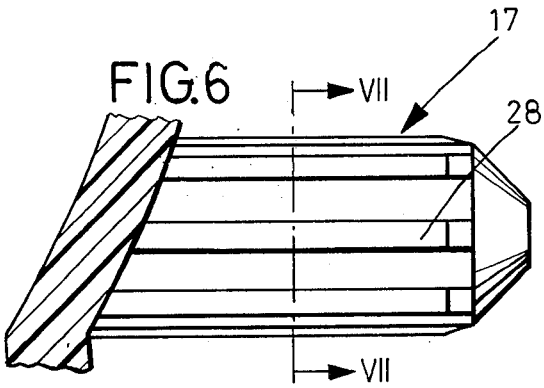
FIG. 6 is a substantially enlarged side elevational view of a connecting pin.
Figure 7:
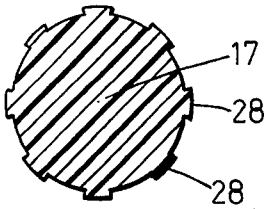
FIG. 7 is a cross-sectional view taken on line VII—VII of FIG. 6.

FIGS. 6 and 7 illustrate one of the connecting pins 17 at considerably enlarged scale. The connecting pin 17 has a substantially circular cross-section and is provided with outwardly extending ribs or bulges 28 which in the illustrated embodiment extend axially of the connecting pin 17.

Before the two shell-shaped hanger halves 11 and 12 are assembled with one another to form the hanger body 13, the head 24 is situated in one of the depressions 22 in such a manner that the shaft 27 of the suspension element 28 is supported in one half of the opening 26. After that, the two shell-shaped hanger halves 11 and 12 are aligned with one another so that the respective connecting pins 17 are aligned with their respective connecting sleeves 16, and then the two hanger halves 11 and 12 are pressed against one another. The connecting pins 17, in addition to connecting the two halves 11 and 12, also serve the purpose of centering the two hanger halves 11 and 12 with respect to one another as a result of the cooperation with the connecting sleeves 16, so that it is achieved that the coupling elements 16 and 17 can be arrestingly engaged with one another without any need for expensive additional assembling devices. The clamping bulges 28 bear against the internal surface of the respective connecting sleeve 16 during the assembling operation of the two shell-shaped hanger halves 11 and 12 and arrest the respective pin 17 in the associated sleeve 16. In this manner, a very strong connection is obtained between the respective pins 17 and the sleeves 16, which connection can be likened to frictional welding.

During the pressing of the two shell-shaped hanger halves against one another, the projecting bulges 18 of the hanger halves 11, 12, and particularly their engaging portions 32, engage in the grooves 18, and particularly the projecting engaging portions 31 provided therein. The bearing 23 prevents the head or support portion 24 of the suspension element 25 from conducting movement axially of the shaft 27.

Figure 8:
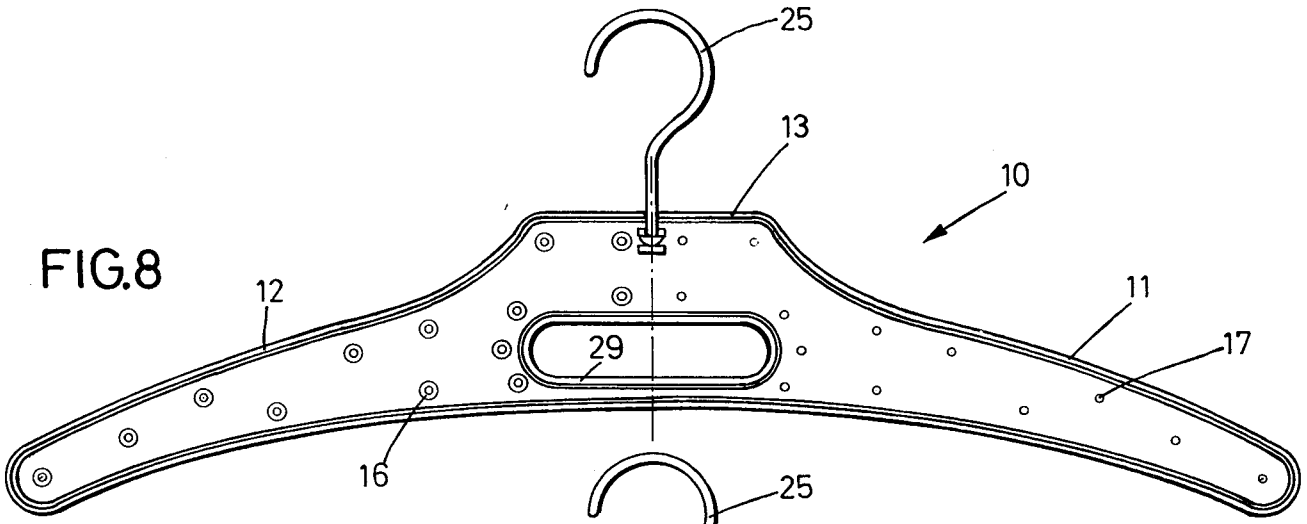
FIG. 8 is a side elevational view of a hanger half according to a further embodiment of the present invention.

FIG. 8 shows a somewhat modified embodiment of the hanger 10, and in this embodiment the same reference numerals have been used to designate similar parts. Like in the previously discussed embodiment, the two shell-shaped hanger halves 11, 12 are connected with one another by means of connecting sleeves 16 and connecting pins 17. The hanger halves 11 and 12 of this embodiment are also provided with the projecting bulges 18 and with the grooves 19 at the marginal portions thereof. However, this embodiment differs from the previously discussed embodiment in that, instead of being provided with a cross-tie 20, the hanger 10, and more particularly the hanger body 13 thereof, is formed with an opening 29 in which ties, belts, scarves and similar articles may be received. The suspension element 25 is connected to the hanger body 13 in the same manner as previously discussed in connection with FIGS. 1 through 7.

Figure 9:
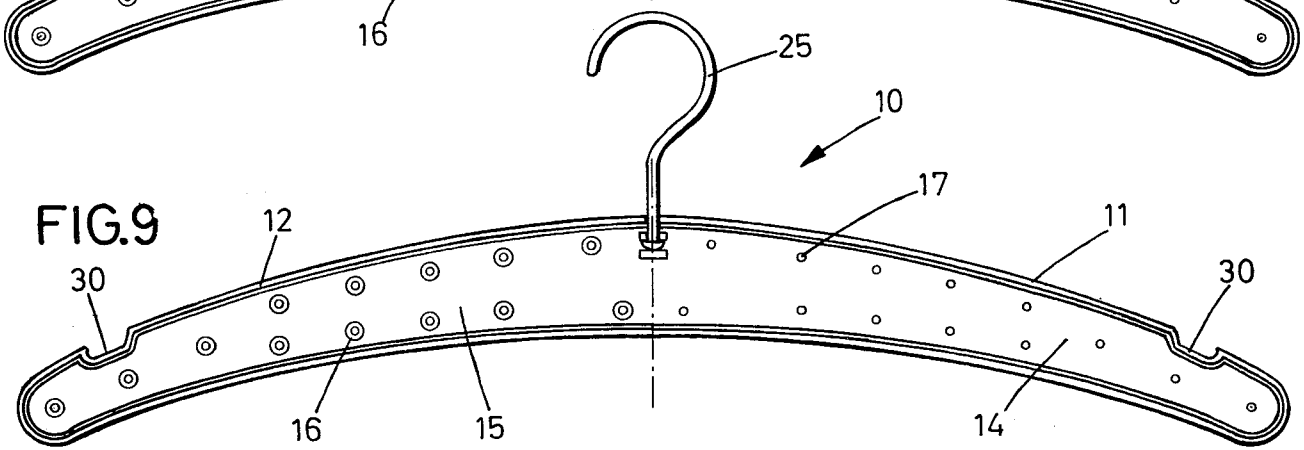
FIG. 9 is a view similar to FIG. 8 of yet another embodiment of the present invention.

A further modified embodiment of the present invention is illustrated in FIG. 9, in which again the same reference numerals have been used to designate corresponding parts. The hanger 10 of this embodiment is formed in the upper portions of the shoulders 14 and 15 with generally hook-shaped depression 30 which serve the purpose of hanging a skirt therein. Here again, the hanger body 13 includes two shell-shaped hanger halves 11 and 12 which are connected with one another in the manner which has been discussed in detail previously. Here again, the connection of the hook-shaped suspending element 25 to the hanger body 13 takes place in the same manner as in the previously discussed embodiments.

It will be understood that each of the elements described above, or two or more together, may also find a useful application in other types of constructions differing from the types described above.

While the invention has been illustrated and described as embodied in a hanger, it is not intended to be limited to the details shown, since various modifications and structural changes may be made without departing in any way from the spirit of the present invention, So, for instance, the connecting pins could be provided with elastically yieldable hook-shaped projections which would then engage either directly the inner cylindrical surface of the sleeve 17, or a recess formed therein. Also, the suspension element 25 could be connected to the hanger body 13 in a different manner, possibly even after the assembly of the two shell-shaped hanger halves 11 and 12, such as, for instance, by providing the end portion of the shaft 27 with elastically yieldable portions which engage in the bearing 23 with snap action after the shaft 27 is inserted through the opening 26. Also, the support portion 24 could be shaped differently from that which is illustrated, and it could include hook-shaped radially extending projections.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hanger, comprising an elongated hanger body including a plurality of shell-shaped hanger halves separated from one another substantially in a longitudinal plane of symmetry of said hanger body, each of said shell-shaped halves having a raised peripheral edge portion bounding a recess which has an inner wall surface, said recesses together forming a hollow interior of said hanger body when said hanger halves are connected together; means for connecting said shell-shaped hanger halves to one another to form said hanger body, said connecting means including a plurality of mating male and female connecting portions formed at a plurality of locations interspersed over the entire inner wall surface of said recesses of the respective halves, said connecting portions of the respective hanger halves matingly engaging one another when said hanger is assembled and extending across said hollow interior of said hanger body so as to simultaneously connect said hanger halves with one another and to impart rigidity to the hanger body at said plurality of locations whereby to reinforce it against flexing; and at least one hook-shaped suspension element connected to said hanger body.

2. A hanger as defined in claim 1, wherein said hanger element are of a synthetic plastic material.

3. A hanger as defined in claim 1, wherein said male connecting portions are formed on one of said hanger halves and said female connecting portions on the other of said hanger halves.

4. A hanger as defined in claim 1, wherein some of said male connecting portions are formed on one of said hanger halves and other on the other of said hanger halves; and wherein the associated female connecting portions are associated with their male counterparts across the plane of symmetry.

5. A hanger as defined in claim 4, wherein said male and female connecting portions are interspersed on each of said hanger halves with one another.

6. A hanger as defined in claim 1 wherein said female connecting portions are connecting sleeves having central openings; and wherein said male connecting portions are pins fittingly received in said central openings of said sleeves when said hanger halves are assembled with one another.

7. A hanger as defined in claim 1, wherein said projecting ridges engage in said grooves with snap action when said hanger halves are assembled.

8. A hanger as defined in claim 1, wherein said suspension element has a shaft formed with a support portion; and wherein said hanger halves are formed with a bearing for receiving said support portion operative in axial direction of said shaft for preventing dissociation of said suspension element from said hanger body when said hanger halves are assembled.

9. A hanger as defined in claim 8, wherein each of said hanger halves is formed with a depression, said depressions together forming a central opening communicating said bearing with the exterior of said hanger body; and wherein said shaft of said suspension element is mounted in said central opening and in said bearing for rotation about its axis relative to said hanger body.

10. A hanger as defined in claim 6, wherein each of said pins is of a substantially circular crosssection and has a plurality of clamping ridges over the outer circumferential surface thereof; and wherein said clamping ridges engage the inner circumferential surface of said central opening of the associated sleeve to prevent disassembly of said hanger halves once assembled.

11. A hanger as defined in claim 1, wherein said hanger body is formed with an oening for accommodating ties, belts, scarves and similar articles therein.

12. A hanger as defined in claim 1, wherein said hanger body has longitudinally spaced end portions; and further including a cross-tie interconnecting said end portions.

13. A hanger as defined in claim 12, wherein said cross-tie is an integral part of said hanger body.

14. A hanger, comprising an elongated hanger body including a pair of shell-shaped hanger halves separated from one another substantially in a longitudinal plane of symmetry of said hanger body, each of said shell-shaped halves having raised peripheral edge portions bounding central recesses, said recesses form together a hollow interior of said hanger body when said hanger halves are connected together; and means for connecting said shell-shaped hanger halves to one another to form said hanger body including first connecting means formed as a plurality of mating male and female connecting portions interspersed within said control recesses of the respective halves and extending across said hollow interior of said hanger body when said hanger is assembled, and second connecting means formed as associated grooves and projecting ridges provided at said peripheral edge portions of said hanger halves, said male portions and said ridges arrestingly engaging said female portions and said grooves, respectively, when said hanger is assembled so as to centrally and peripherally connect with one another and impart rigidity to said hanger halves over the entire surface thereof whereby to reinforce it against flexing.

* * * * *